US007398027B2

(12) United States Patent
Koshida et al.

(10) Patent No.: US 7,398,027 B2
(45) Date of Patent: Jul. 8, 2008

(54) IMAGE FORMING APPARATUS WITH CONVEYANCE SPEED CONTROL BASED IN PART ON LOOP DETECTION

(75) Inventors: Kohei Koshida, Toride (JP); Jiro Shirakata, Kashiwa (JP); Koji Takematsu, Abiko (JP); Hisashi Otaka, Toride (JP); Ken-ichi Manabe, Tokyo (JP); Hideaki Miyazawa, Abiko (JP); Hideaki Kosasa, Abiko (JP); Yuji Yamanaka, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 163 days.

(21) Appl. No.: 11/386,805

(22) Filed: Mar. 23, 2006

(65) Prior Publication Data

US 2006/0222386 A1 Oct. 5, 2006

(30) Foreign Application Priority Data

Mar. 30, 2005 (JP) ..... 2005-097089

(51) Int. Cl.
*G03G 15/20* (2006.01)

(52) U.S. Cl. ..... 399/68

(58) Field of Classification Search ..... 399/44, 399/45, 68, 400

See application file for complete search history.

(56) References Cited

U.S. PATENT DOCUMENTS

| | | | | |
|---|---|---|---|---|
| 4,941,021 | A * | 7/1990 | Uchida et al. | 399/322 |
| 7,196,827 | B2 | 3/2007 | Yamanaka | 358/496 |
| 7,251,426 | B2 * | 7/2007 | Koshida | 399/68 |
| 2003/0156853 | A1 * | 8/2003 | Fukutani | 399/68 |
| 2005/0128536 | A1 | 6/2005 | Yamanaka et al. | 358/488 |
| 2006/0051116 | A1 | 3/2006 | Koshida | 399/68 |
| 2006/0086727 | A1 | 4/2006 | Takematsu et al. | 219/619 |
| 2006/0088333 | A1 | 4/2006 | Watanabe et al. | 399/107 |
| 2006/0120744 | A1 | 6/2006 | Shirakata et al. | 399/68 |
| 2006/0222394 | A1 | 10/2006 | Koshida | 399/68 |
| 2006/0263128 | A1 | 11/2006 | Takematsu et al. | 399/401 |
| 2007/0059023 | A1 | 3/2007 | Koshida | 399/92 |

FOREIGN PATENT DOCUMENTS

| | | |
|---|---|---|
| JP | 5-107966 | 4/1993 |

* cited by examiner

*Primary Examiner*—Ryan Gleitz
(74) *Attorney, Agent, or Firm*—Fitzpatrick, Cella, Harper & Scinto

(57) ABSTRACT

Conveyance speed of recording materials by a fixing roller pair can be set to conveyance speed based on detected results of a recording material detector and a loop detecting sensor, and information on the recording material that has been stored in a memory in advance, and the conveyance speed of the fixing roller pair is set so that loop length of the recording material will be a lower limit length, after the loop detecting sensor detects a loop of the recording material, and before the rear end of the recording material passes through the transfer roller pair.

5 Claims, 14 Drawing Sheets

*FIG. 5*

Memory 50

| Mode | Environment | Paper thickness | L 0 | L 1 | L a | L b |
|---|---|---|---|---|---|---|
| Single-side | High temperature | Thin paper | c 1 | d 1 | e 1 | f 1 |
| | | Plain paper | c 2 | d 2 | e 2 | f 2 |
| | | Thick paper | c 3 | d 3 | e 3 | f 3 |
| | Low temperature | Thin paper | c 4 | d 4 | e 4 | f 4 |
| | | Plain paper | c 5 | d 5 | e 5 | f 5 |
| | | Thick paper | c 6 | d 6 | e 6 | f 6 |
| Both-side | High temperature | Thin paper | c 7 | d 7 | e 7 | f 7 |
| | | Plain paper | c 8 | d 8 | e 8 | f 8 |
| | | Thick paper | c 9 | d 9 | e 9 | f 9 |
| | Low temperature | Thin paper | c 10 | d 10 | e 10 | f 10 |
| | | Plain paper | c 11 | d 11 | e 11 | f 11 |
| | | Thick paper | c 12 | d 12 | e 12 | f 12 |

| Paper type | S |
|---|---|
| a 1 | b 1 |
| a 2 | b 2 |
| a 3 | b 3 |
| a 4 | b 4 |
| a 5 | b 5 |
| a 6 | b 6 |
| a 7 | b 7 |
| a 8 | b 8 |
| a 9 | b 9 |

IMAGE FORMING APPARATUS WITH CONVEYANCE SPEED CONTROL BASED IN PART ON LOOP DETECTION

BACKGROUND OF THE INVENTION

1. Field of the Invention

The present invention relates to an image forming apparatus that transfers unfixed images to recording materials by a transfer means, and fixes the unfixed images on the recording materials by a fixing means.

2. Description of the Related Art

Conventionally, as shown in FIG. 14, an electrophotographic type image forming apparatus transfers unfixed images borne by an intermediate transfer belt 102 to recording materials P by a transfer roller pair 103, fixes the unfixed images on the recording materials P by a fixing roller pair 105, and discharges the recording materials on which the images have been fixed to a discharge tray 107 outside the apparatus, by a discharge roller pair 111.

The fixing roller pair 105 heat-fixes the unfixed images to the recording materials. However, the heat temporarily removed from the fixing rollers through the fixing process varies depending on amount of deposit of developer that forms unfixed images transferred to the recording materials, the number of passing recording materials per unit time that passes through the fixing roller pair, difference in heat capacity of the recording materials. A temporary temperature change that takes place in the fixing roller pair 105 appears as a change of size of the outer diameter of the rollers. This might lead to a difference between the conveyance speed of the recording materials by the fixing roller pair 105 and the conveyance speed of the recording material by the transfer roller pair 103.

Such a difference between the conveyance speeds of the recording materials of the fixing roller pair 105 and the transfer roller pair 103, if any, might result in a deterioration of the image. In other words, when the conveyance speed of the recording materials by the fixing roller pair 105 is faster than that of the recording materials by the transfer roller pair 103, the recording materials are stretched between the fixing roller pair 105 and the transfer roller pair 103, causing image disturbance or the like, thereby leading to image deterioration when images are transferred to the recording materials P by the transfer roller pair. On the other hand, when the conveyance speed of the recording materials by the fixing roller pair 105 is slower than that of the recording materials by the transfer roller pair 103, the recording materials form an oversize loop between the fixing roller pair 105 and the transfer roller pair 103. Then, the recording materials P that form the oversize loop are pressed hard and scraped against a conveyance guide 120, and the scraping against the conveyance guide 120 might cause image disturbance, thereby resulting in deteriorated images when they are transferred. Thus, the following proposal has been made previously for solving the problem of image deterioration as described above, by forming a predetermined loop on recording materials P between the transfer roller pair 103 and the fixing roller pair 105 and thus preventing the recording materials P from being stretched or bending too much.

As shown in FIG. 14, a loop detecting sensor 12 which detects a loop of recording materials P is provided on the conveyance guide 120 between the fixing roller pair 105 and the transfer roller pair 103. Based on result of the detection, the conveyance speed of the recording materials by the fixing roller pair 105 is switched to a first speed that is slower than the conveyance speed of the recording materials by the transfer roller pair, or to a second speed that is faster the first speed, so that the predetermined loop can be maintained. Such the technology is disclosed in Japanese Patent Application Laid Open (JP-A) No. 05-107966 Publication.

In order to maintain recording materials in a predetermined loop, however, the fixing roller pair is switched to the first speed or the second speed so that a predetermined loop can be maintained. Thus, there is a fear that noise would result from the switching of the conveyance speed of the fixing roller pair. In addition, there is also another fear that poor images might occur, such as image blurring at the transfer portion or fixing nonuniformity at the fixing device, due to periodic minor vibration caused by the switching operation of the conveyance speed.

SUMMARY OF THE INVENTION

It is an object of the present invention to reduce occurrence of noise or poor images, etc., due to switching of conveyance speed of a fixing roller pair, while preventing image deterioration attributable to recording materials that are stretched or bend too much between a transfer roller pair and the fixing roller pair. The present invention includes a transfer means which transfers unfixed images borne by an image bearing member to recording materials, a fixing means which fixes the transferred unfixed images on the recording materials, a loop detecting means which detects a loop of the recording materials to be formed between the transfer means and the fixing means, a recording material detection means which determines that the recording materials have reached to the fixing means, and a control means which controls conveyance speed of the recording materials by the fixing means, wherein based on the detection result of the recording material detection means and the loop detecting means and, length of the recording material, the control means sets the conveyance speed of the fixing means so that when a rear end of the recording material passes through the transfer means after the loop detecting means detected the loop of the recording material, a loop length of the recording material will be set to a lower limit length, and the control means controls the conveyance speed of the fixing means at the set conveyance speed.

BRIEF DESCRIPTION OF THE DRAWINGS

FIG. 5 is a graphic chart that exemplifies various setting information stored in advance in a memory.

DESCRIPTION OF THE EMBODIMENTS

In the following, with reference to the drawings, preferred embodiments will be illustratively described in details. Provided that dimensions, materials, shapes, relative arrangement thereof of components described in the following embodiments should be changed as appropriate according to configuration or various conditions of an apparatus to which the present invention is applied, and it is not intended that the scope of the invention is limited to them unless otherwise specified.

First Embodiment

Figure 1:
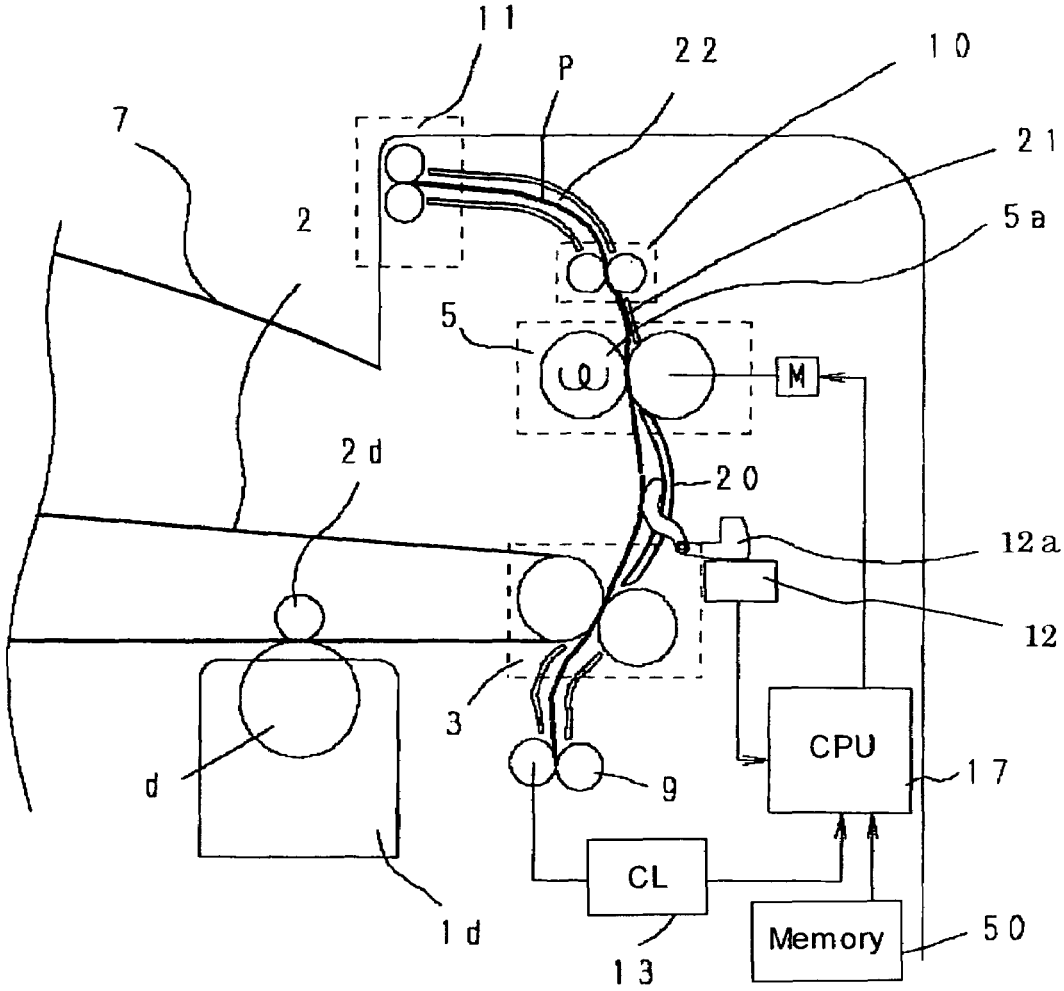
FIG. 1 is a sectional view of a substantial part showing one embodiment of an image forming apparatus to which the present invention is applied.
Figure 2:
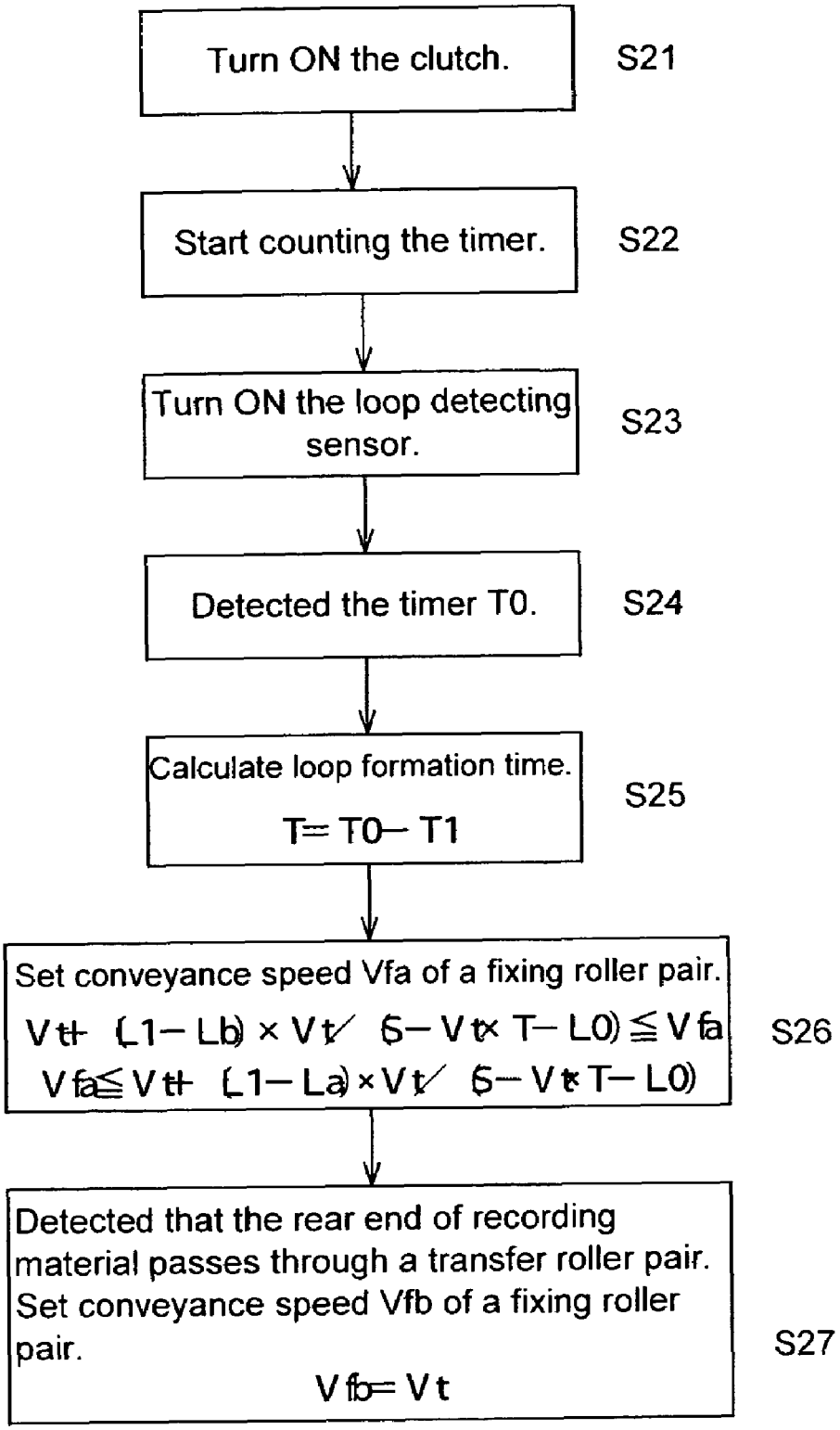
FIG. 2 is a flow chart showing one example of control of the image forming apparatus.
Figure 4:
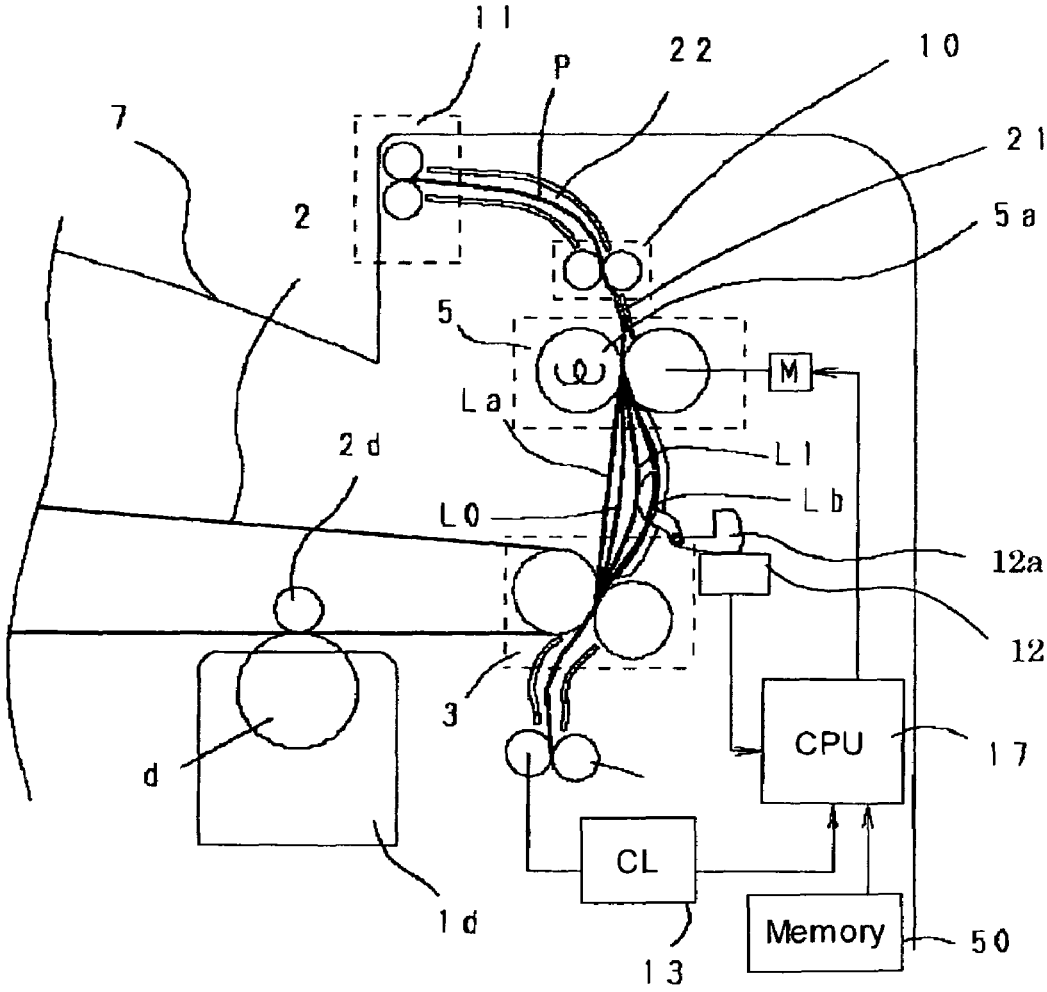
FIG. 4 is a sectional view of a substantial part showing one example of a loop shape between a transfer roller pair and a fixing roller pair.
Figure 13:
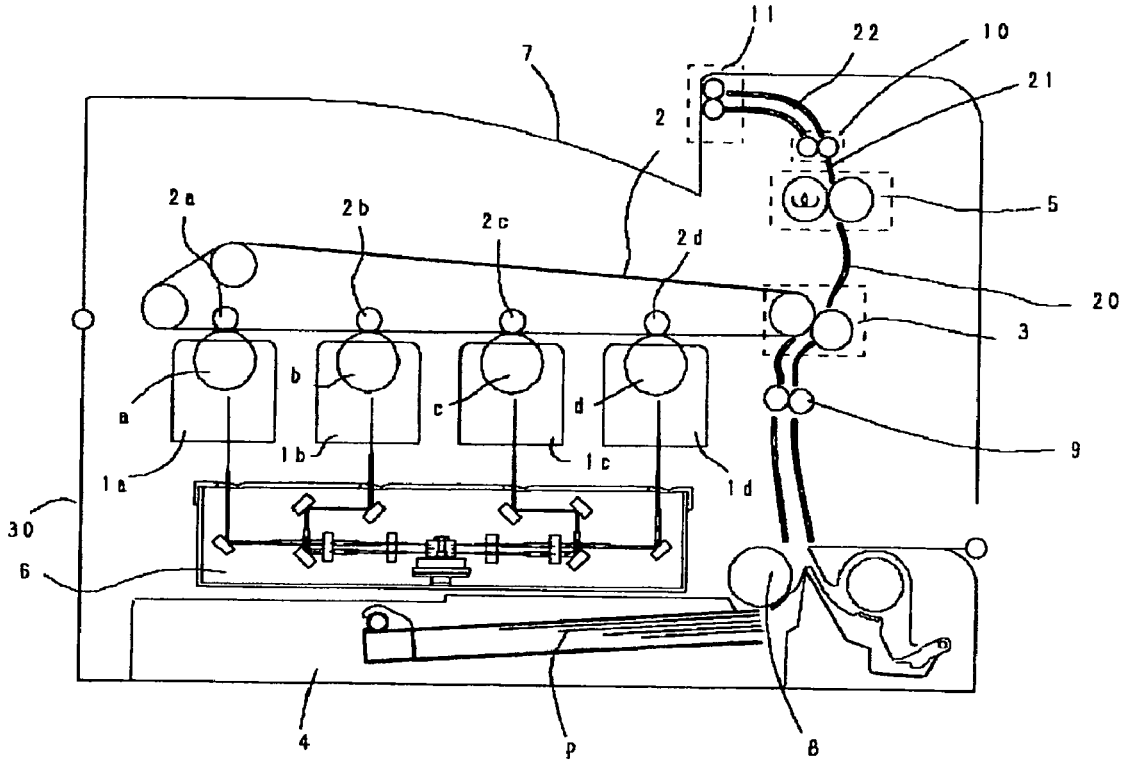
FIG. 13 is a sectional view of one example of an image forming apparatus.
Figure 14:
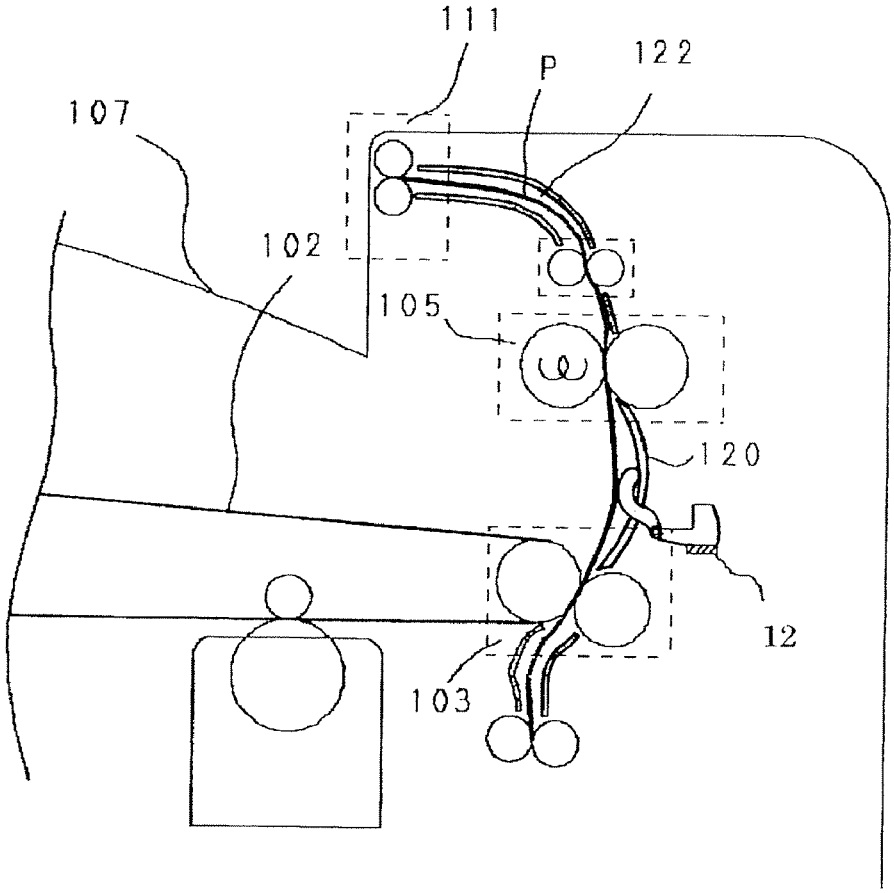
FIG. 14 PRIOR ART
FIG. 14 is a sectional view of a substantial part of the image forming apparatus showing conditions of the loop between the conventional transfer and fixing rollers.

Here, an image forming apparatus according to a first embodiment of the invention will be described with reference to the drawings. FIG. 1 is a sectional view showing schematic configuration of substantial parts of the image forming apparatus according to the embodiment of the invention. FIG. 2 is a flow chart showing behavior of the image forming apparatus according to the embodiment of the present invention. FIG. 4 is a block diagram of the image forming apparatus according to the embodiment of the present invention. FIG. 4 is a sectional view showing one example of a loop shape between a transfer roller pair and a fixing roller pair. FIG. 5 is a graphic chart showing each setting information on the recording sheet that has been stored in advance in the memory. FIG. 13 is a sectional view of the entire configuration of the image forming apparatus according to the embodiment of the invention.

First, a schematic configuration of the entire image forming apparatus will be described with reference to FIG. 13. Then, using FIGS. 1 to 5, a loop control of recording materials will be described according to information of the recording materials.

The image forming apparatus 30 shown in FIG. 13 includes photosensitive drums a (yellow), b (magenta), c (cyan), d (black) as the image bearing members (photosensitive members of electrophotography) which are arranged in parallel to each other and form toner images of respective colors of yellow, magenta, cyan and black, for instance, and an intermediate transfer belt 2 as an intermediate transfer member arranged so as to traverse longitudinally on the upper part of the photosensitive drums.

Around the respective photosensitive drums a, b, c, and d driven by a motor (not shown), a primary charger, a development device and the like. (respectively not shown) are arranged, and unitized as process cartridges 1*a*, 1*b*, 1*c*, and 1*d* that can be detachably loaded into the main body of the image forming apparatus 30.

In addition, an exposure device 6 composed of a polygon mirror and the like is arranged beneath the photosensitive drums a to d.

First, laser light by an image signal in yellow component color is projected to the photosensitive drum a in a first image forming device via a polygon mirror of an exposure device 6, etc., an electrostatic latent image is formed on the photosensitive drum a, to which yellow toner is supplied from the development device for development, and the electrostatic latent image is visualized as an yellow toner image.

When the toner image reaches a first transfer member against which the photosensitive drum a and the intermediate transfer belt 2 abut, as the photosensitive drum a rotates, primary transfer bias applied to a transfer charging member 2*a* allows the yellow toner image on the photosensitive drum a to be transferred to the intermediate transfer belt 2 (primary transfer). When the member bearing the yellow toner image of the intermediate transfer belt 2 moves to the next image forming portion, a magenta toner image has been formed on the photosensitive drum b and in the primary transfer member against which the photosensitive drum b in the process similar to that for the above image forming portion, and the intermediate transfer belt 2 abut, the magenta image is superimposed on the yellow toner image on the intermediate transfer belt 2, and then transferred. At the same time, in the primary transfer member, a cyan toner image and a black toner image are sequentially superimposed on the yellow toner image and magenta toner image, and then transferred as the intermediate transfer belt 2 moves.

On the other hand, recording materials P are housed in a cassette 4. Sent out sheet by sheet by a pickup roller 8, the recording materials P reach a secondary transfer member after being timed by a registration roller 9, the four-color toner images on the intermediate transfer belt 2 are collectively transferred onto the recording material P by the secondary transfer bias applied to a secondary transfer roller pair 3 as a transfer means (secondary transfer).

Then, the recording material P on which the four-color toner images are transferred is guided by a conveyance guide 20, conveyed to a fixing roller pair 5 as a fixing means located above the transfer roller pair 3, where the four-color toner images are fixed by heat and pressure. This enables toner of respective colors to melt, mix, and fix as a full-color print image on the recording materials P. Then, recording material P is guided by the conveyance guides 21, 22, the recording materials P on which the image is fixed are discharged to a discharge tray 7 by a discharge roller pair 11 as a discharge means provided downstream of the fixing roller pair 5.

In the case of single-side mode wherein an image is formed on one side of recording materials P, the recording material P on one side of which the image is formed as described above is discharged to the discharge tray 7 by the discharge roller pair 11. On the other hand, in the case of double-side mode wherein an image is formed on both sides of recording materials P, the recording material P on one side of which the image is formed as described above passes through a double-sided path (not shown), and conveyed to a registration roller pair 9 while both sides being inverted. Then, recording on the backside is completed with the image forming process similar to the front face recording, and then the recording material P on both sides of which the image is formed on the both sides is discharged to the discharge try by a discharge roller pair 11.

Here, with reference to FIG. 1 to FIG. 5, the loop control of recording materials that is carried between a transfer roller pair 3 and a fixing roller pair 5, in the image forming apparatus will be described.

Figure 3:
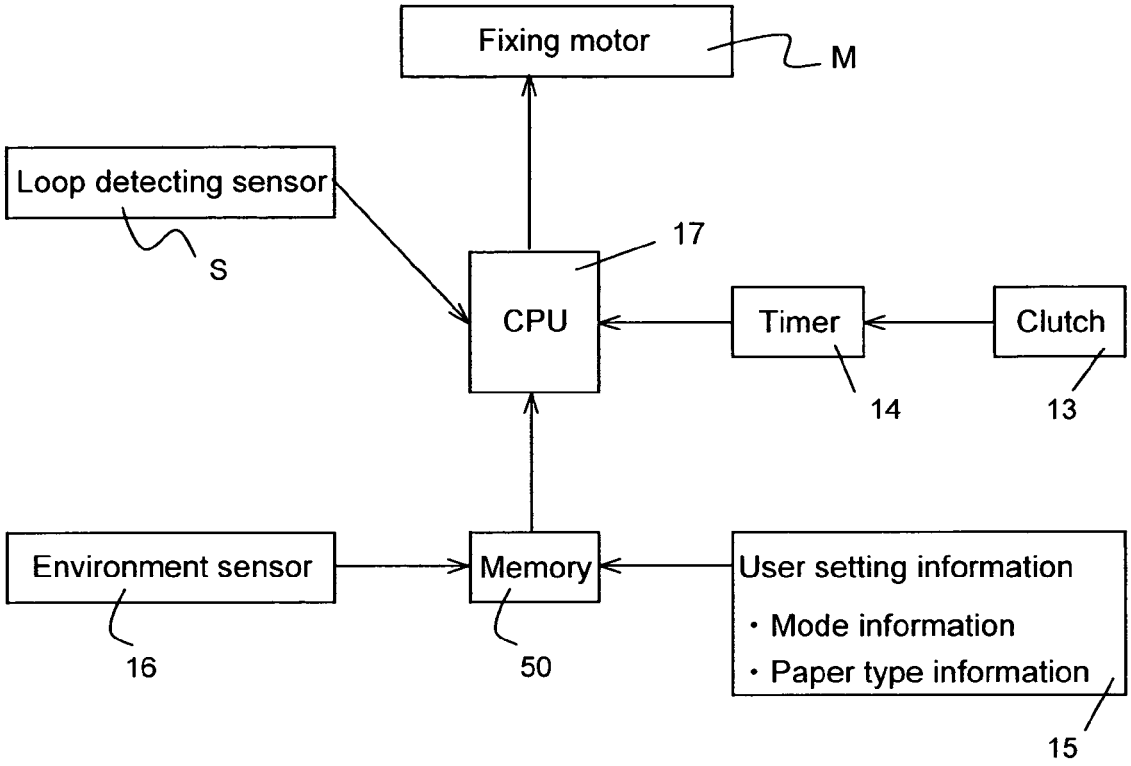
FIG. 3 is a block diagram showing a control system of the image forming apparatus.

As shown in FIG. 1 and FIG. 3, the image forming apparatus according to the present embodiment has a CPU 17 as a control means, a loop detecting sensor 12 as a loop detecting means that detects a loop of recording materials P formed between the transfer roller pair 3 and the fixing roller pair 5, a recording material detection means capable of detecting or calculating that the recording material P has entered the fixing roller pair 5, and a memory 50 as a storage means in which information on the recording materials P have been stored in advance.

In the present embodiment, the recording material detection means includes a clutch 13 that transmits (ON) or cuts off (OFF) the driving force to the registration roller pair 9 and a timer 14 that measures time after the clutch 13 has turned ON, and calculates that the recording material P has reached the nip of the fixing roller pair 5. In addition, CPU 17 controls the drive of fixing motor M, which is a fixing drive portion for driving the fixing roller pair 5, and calculates an arbitrary conveyance speed based on the detected result of the recording material detection means and the loop detecting sensor 12, and the information on the recording materials P that has been stored in the memory 50 in advance. Then, CPU 17 can set the conveyance speed of the recording material by the fixing roller pair 5 to the arbitrary conveyance speed. In other words, CPU 17 controls driving of the fixing motor M so that the fixing roller pair 5 can convey the recording materials at the set conveyance speed.

In addition, the fixing roller pair 5 of which the conveyance speed is set by the CPU 17 conveys the recording material P that runs into the nip of the fixing roller pair 5 at a constant recording material conveyance speed Vfa after the loop detecting sensor 12 detects a loop of the recording materials P. A constant recording material conveyance speed Vfa of the set fixing roller pair, to be detailed later, is constant conveyance speed that allows the loop length of the recording material P to be a length of lower limit La (See FIG. 4).

Here, a control system of the image forming apparatus will be described. As shown in FIG. 3, 17 designates a CPU as the control means. M represents a fixing motor whose driving is controlled by CPU 17. The numeral 12 designates a loop detecting sensor that detects recording materials P between a transfer roller pair 3 and a fixing roller pair 5. The numeral 13 being a clutch and 14 being a timer constitute the recording material detection means. The numeral 50 is a memory in which information on recording materials P has been stored in advance. The numeral 15 is user set information, and detects mode information, sheet thickness information, sheet type information, etc., to be discussed later. The numeral 16 is an environmental server as an environmental information detection means, and detects humidity in the embodiment.

In addition, the information relating to the recording materials P is at least one of mode information that shows image formation on a single side or both sides of the recording materials P, information on thickness and a type of the recording materials, and the environmental information. As shown in FIG. 5, the present embodiment exemplifies the case in which the mode information showing either single side mode or both side mode, information on thickness of the recording materials, information on a type of the recording materials, and information on humidity as environmental information are used as information on the recording material P. Then, as setting information corresponding to a combination of the various information, length of the loop of recording materials to be discussed later, L0, L1, La, Lb and each data on length of conveyance direction S, c1 to c12, d1 to d12, e1 to e12, f1 to f12, b1 to b9 have been stored in the memory 50 in advance.

In the following, in the image forming apparatus of the above configuration, the behavior of the fixing roller pair 5 will be described including the loop control of the recording materials to take place between the transfer roller pair 3 and the fixing roller pair 5.

The recording materials P is sent out sheet by sheet from the cassette 4 by the pickup roller 8 and timed by stopped registration rollers 9. Then, when the clutch 13 is turned ON (Step S21), driving force is transmitted to the registration rollers 9 that then convey the recording material P toward the secondary transfer roller pair 3. In addition, at the same time when the clutch 13 is turned ON, the timer 14 starts counting (Step S22).

The recording material P on which the four-color toner image was collectively transferred (secondary transfer) by the secondary transfer roller pair 3 is guided by the conveyance guide 20, and runs into the nip part of the fixing roller pair 5 while forming a loop of L0 as shown in FIG. 4. Then, the fixing roller pair 5 is driven by the fixing motor M that is a fixing drive independent from the drive source for the photosensitive drums, intermediate transfer belt, etc. As the conveyance speed Vf of the recording materials V of the fixing roller pair 5 has been set, in advance, slower than the conveyance speed Vt of the recording materials of the secondary transfer roller pair 3 (Vf<Vt), a loop formed by the recording materials P becomes larger in progression.

Then, when length of the loop of the recording materials P between the secondary transfer roller pair 3 and the fixing roller pair 5 reaches L1 as shown in FIG. 4, i.e., when the loop detecting sensor that detects flag 12*a* oscillates and the loop detecting sensor 12 turns ON (Step S23), it detects the count time T0 of the timer 14 (Step S24). Then, it calculates the loop formation time T(=T0−T1) by subtracting the time T1 from when the clutch 13 turns ON till when the recording material P runs into the fixing roller pair 5 from the detected count time T0 (Step S25). The time T1 is a constant that has been set in advance in the table of the memory 50. The loop formation time T is a loop formation time from when the recording material runs into the fixing roller pair 5 till when the loop detecting sensor 12 detects a loop of the recording material P.

Then, the actual speed Vf=Vt−(L1−L0) of the conveyance speed of the recording material of the fixing roller pair 5 is calculated from the loop formation time T.

Then, the recording material P that runs into the nip of the fixing roller pair 5 and for which the loop L1 is detected by the loop detecting sensor 12 is, as described above, conveyed at the constant conveyance speed Vfa by the fixing roller pair 5 the conveyance speed of which is set by the CPU 17. The conveyance speed of the recording material Vfa of the fixing roller pair 5 is set to fall within the range expressed by the following expressions (1), (2), based on the detected count time T0 and the setting information stored in advance in the memory 50 (See FIG. 5) (Step S26).

The conveyance speed Vfa till the rear end of a sheet comes out of the secondary transfer roller pair 3 should satisfy the following relationship for preventing a loop from being formed excessively large between the secondary transfer roller pair 3 and the fixing roller pair 5 or from preventing a loop from being stretched from both sides. T2 is the time from when the loop detecting sensor that detects the loop till the rear end of the sheet comes out of the secondary transfer roller pair 3.

$$Vt+(L1-Lb)/T2 \leqq Vfa \leqq Vt+(L1-La)/T2$$

Where since the sheet length is S, T2=(S−Vt×T−L0)/Vt, the following expression can be obtained by assigning this to the above expression.

$$Vt+(L1-Lb)\times Vt/(S-Vt\times T-L0)\leqq Vfa \quad (1)$$

$$Vfa\leqq Vt+(L1-La)\times Vt/(S-Vt\times T-L0) \quad (2)$$

The conveyance speed of the recording Vfa of the fixing roller pair 5 to be set within the range shown by (1) and (2) of the above expressions is conveyance speed that allows the loop length of the recording material P to be length of the lower limit La till the rear end of the recording sheet P comes out of the transfer roller pair 3. Then, the conveyance speed of the recording material Vfa is a constant conveyance speed faster than the conveyance speed of the recording material Vt by the transfer roller pair 3.

In the above expressions, L0 represents the loop length of the recording materials P between the transfer roller pair 3 and the fixing roller pair 5 when the recording materials P run into the fixing roller pair 5. L1 represents the loop length of the recording material P between the transfer roller pair 3 and the fixing roller pair 5 when the loop is detected by the loop detecting sensor 12. La represents the loop length at the lower limit of the recording materials P between the transfer roller pair 3 and the fixing roller pair 5. The loop length La is a lower limit value which causes the recording material P to be stretched between the transfer roller pair 3 and the fixing roller pair 5 if the loop length of the recording materials between the transfer roller pair 3 and the fixing roller pair 5 becomes smaller than La, in the present embodiment. However, the loop lower limit length La may not necessarily be limited to the border between the condition in which the loop of the recording materials is formed and the condition in which the loop is stretched (lower limit of the loop length), but may be set to the condition in which there remains some bending to the extent that the hopping of the rear end of the recording materials is not easily generated when the recording material P passes through the transfer roller pair 3. Lb represents the upper limit loop length of the recording material P between the transfer roller pair 3 and the fixing roller pair 5. The upper limit loop length Lb is the upper limit of the loop length that causes too much bending of the recording material P between the transfer roller pair 3 and the fixing roller pair 5, if the loop length between the transfer roller pair 3 and the fixing roller pair 5 exceeds Lb. The relationship among the loop length of the recording materials shall be La<L0<L1<Lb. In addition, Vt represents conveyance speed of the recording material of the transfer roller pair 3, and S is the length of the recording material in the conveyance direction.

FIG. 4 shows a loop shape between the secondary transfer roller pair 3 and the fixing roller pair 5 (loop length, L0, L1, La, Lb), wherein the loop length of the recording materials L0, L1, La, Lb and the length of the recording material S in the conveyance direction are the constants that have been stored in the memory 50 in advance. As shown in FIG. 5, these constants are set based on the mode information of single-sided printing or double-sided printing, information on thickness of the recording materials, sheet type information of the recording materials, and environmental information, as information on the recording materials. Here, the magnitude correlation between the respective setting information will be described as shown in FIG. 5.

Figure 6:
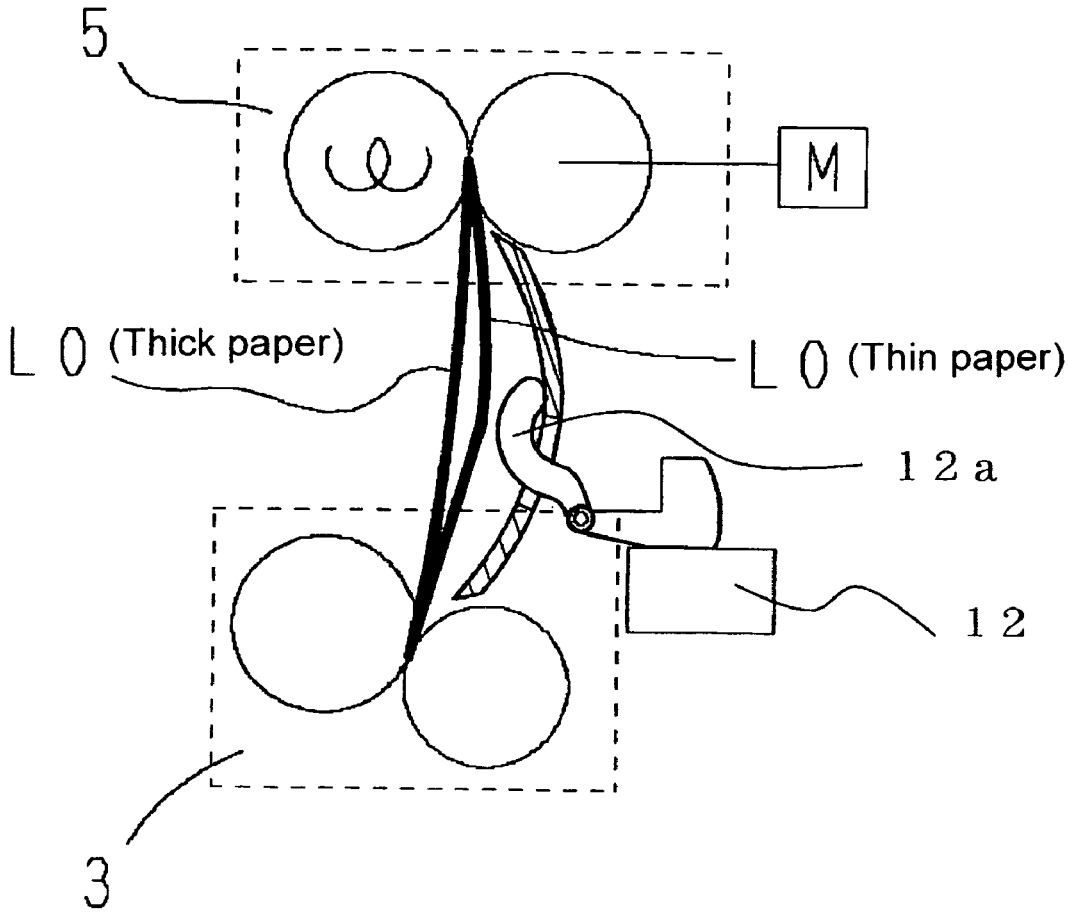
FIG. 6 is a sectional view of a substantial part showing length of a loop of a recording material between a transfer roller pair and a fixing roller pair when the recording material runs into the fixing roller pair.

As for L0, the loop length of the recording materials P between the transfer roller pair 3 and the fixing roller pair 5 when the recording materials runs into the fixing roller pair 5, if thickness of the recording materials is different, as shown in FIG. 6, a loop is formed less often because thick paper has higher rigidity of recording material itself than thin paper. In other words, the loop length of the recording material P shall be c3<c2<c1 if one example of magnitude correlation among the methods of setting is taken as shown in FIG. 5. In addition, since recording material P in double-sided mode is curled larger than that in the single-sided mode, a different setting is assigned to the loop length L of the recording materials P. In the present embodiment, magnitude correlation among the methods of setting is c1<c7.

As for the loop length L1 of the recording material P between the transfer roller pair 3 and the fixing roller pair 5 when the loop detecting sensor 12 detects a loop, angle of inclination slope in the vicinity of the nip of the respective roller pair differs depending on rigidity (thickness) of the recording materials P. In other words, the loop length L1 of the recording material P is greater in thin paper than that in thick paper. Thus, the loop length L1 of the recording material P shall be d3<d2<d1 if one example of the magnitude correlation among respective setting information is taken as shown in FIG. 15.

Figure 7:
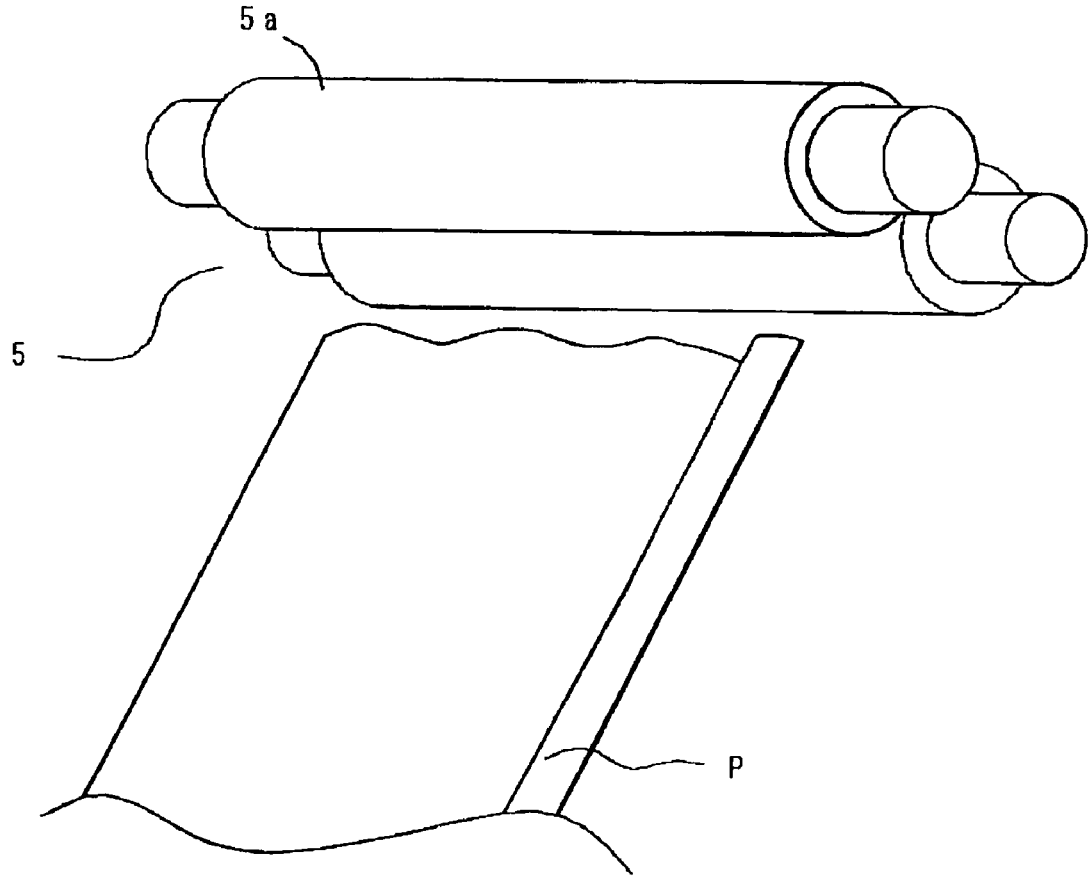
FIG. 7 is a perspective view exemplifying a waving shape of a recording material.

If the recording sheet is thick, the lower limit loop length La of the recording sheet P of the transfer roller pair 3 and the fixing roller pair 5 may be loop length almost equal to the loop length in a stretched condition. However, if the recording material is plain paper that is thinner than thick paper and if it is in a high humidity environment, the recording material P may possibly ripple in the width direction that crosses the conveyance direction, as shown in FIG. 7. In this case, the recording material P having an unfixed image may cause image disturbance because the ridge of the recording material P on which the unfixed image is borne touches the fixing roller 5*a* on the side of the unfixed image before it goes into the nip of the fixing roller pair 5. Thus, the lower limit loop length that does not cause image disturbance as described above should be set for the lower limit loop length La of the recording material P. In other words, the lower limit loop length La of the recording sheet P shall be e3<e2<e1 if one example of magnitude correlation is taken as shown in FIG. 5.

If the recording paper P is thin, the upper limit loop length Lb of the recording material P between the transfer roller pair 3 and the fixing roller pair 5 may be in the marginal condition of bending immediately before the recording material P touches the conveyance guide 20. However, if a loop is formed excessively large as with the case of the thin paper when the recording material is thicker than thin paper, the recording material P nipped by the transfer roller pair 3 slips, thus the images in the conveyance direction of the recording material may stretch or contract. Thus, loop length that does not affect image expansion/contraction shall be set for the upper limit loop length Lb of the recording material P. In other words, the upper limit loop length Lb of the recording material shall be f3<f2<f1 if one example of magnitude relation is taken as shown in FIG. 5.

Although, as described above, these setting values L0, L1, La, Lb are exemplified that they are based on rigidity (paper thickness) of the recording materials, the respective setting values L0, L1, La, Lb may differ depending on humidity as environmental information, in addition to paper thickness. For instance, even if thin paper of the recording material has a same thickness, loop of the recording material will be larger if humidity as environment information is higher than in the case where the humidity is low. Thus, if the magnitude correlation among respective setting information in terms of humidity as environmental information is exemplified, they are c1>c4, d1>d4, e1>e4, f1>f4.

In addition, as for length of the recording material S2 in the conveyance direction, a setting value associated with the paper type information of user set information 15 is started. Also, in the present embodiment, the environmental sensor 16, the paper type information and the mode information shall be detected by the user setting information 15.

In the image forming apparatus of the present embodiment, when the rear end of the recording material P passes through the transfer roller pair 3 with the upper limit loop length being Lb, the rear end of the recording material P hops and causes poor images. Thus, as described above, the conveyance speed of the recording material Vfa by the paper of fixing rollers 5 is set so that the rear end of the recording material P can pass through the transfer roller pair 3 with the lower limit loop length being La as shown in FIG. 4. This could minimize hopping of the rear end of the recording materials P when the rear end of the recording materials P comes out of the transfer roller pair 3 and thus reduce poor images caused by the hopping of the rear end of the recording material.

Then, if conveyance of the recording material by the fixing roller pair 5 continues at the conveyance speed of Vfa, after the rear end of the recording material P comes out of the secondary transfer roller pair 5, the recording materials P might scrape against the conveyance guides 21, 22, thereby causing poor images after fixing, because the conveyance speed Vfa is faster than the conveyance speed of the recording materials Vt by the transfer roller pair 3.

Thus, the timing for the rear end of the recording material P to come out of the secondary transfer roller pair 3 is set with a value of the count time of the timer 14, and the conveyance speed of the recording material Vfb of the fixing roller pair 5 is set to be equal to the conveyance speed of the recording material Vt of the transfer roller pair 3, when the predetermined time is reached (Step S27).

Then, the recording material P is discharged to the discharge tray by the discharge roller pair 11 provided downstream of the fixing roller pair 5.

Figure 8:
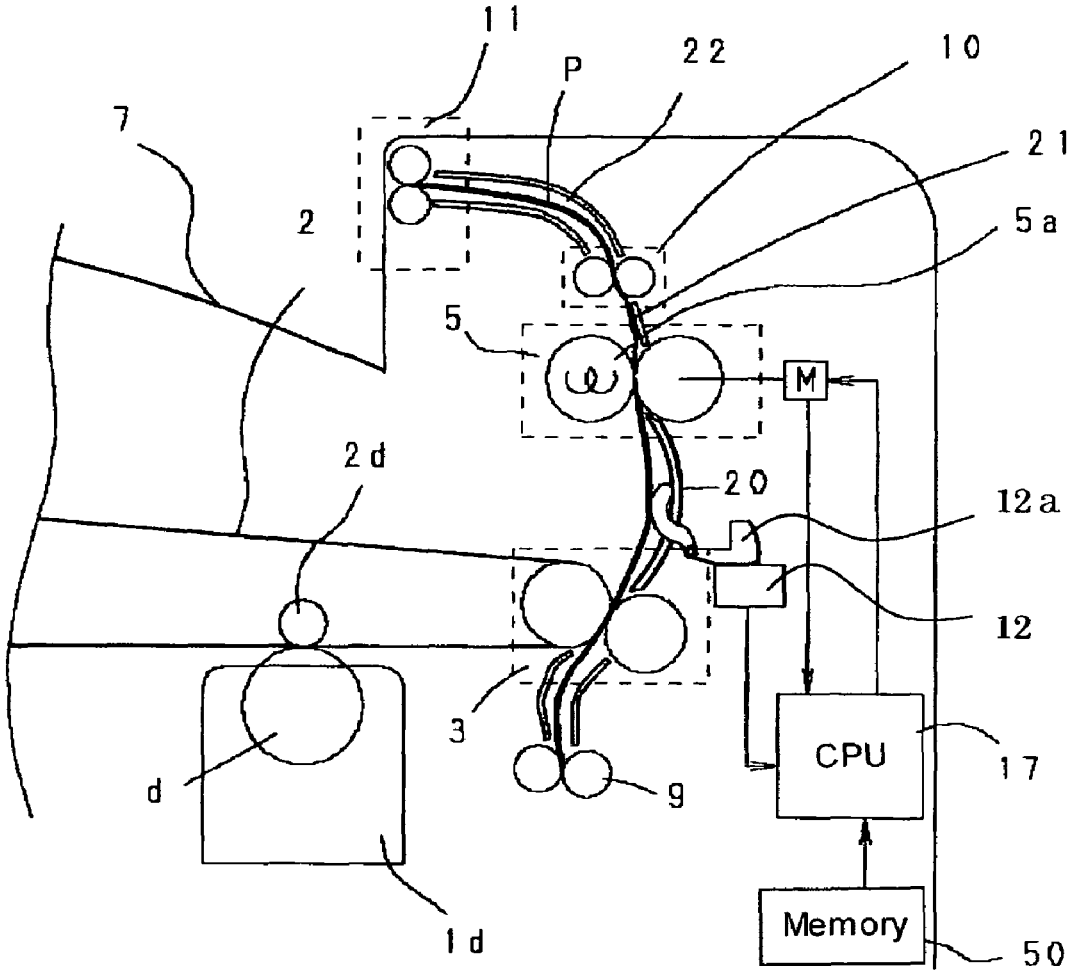
FIG. 8 is a sectional view of a substantial part showing other embodiments of the image forming apparatus to which the present invention is applied.

In the present embodiment, it is exemplified that the configuration wherein as the recording material detection means for detecting or calculating that the end of the recording material has reached the nip of the fixing roller pair, the timing when the end of the recording materials P reaches the nip of the fixing roller pair is calculated from ON timing of the clutch 13 of the registration roller 9. However, the recording material detection means shall not be limited to this. For instance, the configuration may be acceptable wherein as the recording material detection means for detecting that the top end of the recording material has reached the nip of the fixing roller pair 5, as shown in FIG. 8, timing when torque of the fixing motor M varies as the top end of the recording material P runs into the nip of the fixing roller pair 5 may be read.

As described above, according to the present embodiment, any noise or poor images, etc. due to switching of the conveyance speed of the fixing roller pair 5 can be reduced, while preventing image deterioration due to the recording material P being stretched or bending too much between the transfer roller pair 3 and the fixing roller pair 5.

In addition, since the conveyance speed of the recording material Vfa of the fixing roller pair 5 can be calculated according to information on the recording material P, any poor images due to the loop condition of the recording material from when the recording material P is nipped by the fixing roller pair 5 till the time when it passes through the nip of the transfer roller pair 3. In addition, the conveyance speed of the recording materials Vfa of the fixing roller pair 5 can be calculated in a simple and inexpensive manner because the information on the recording material P uses the constants that have been set in advance in the memory 50, in calculating the conveyance speed of the recording material of the fixing roller pair 5.

In addition, even when the mode information such as single side/double side, paper thickness, paper type or environment is changed, a loop of appropriate recording material can be formed, thus reducing poor images due to the loop condition of the recording materials.

Since it is possible to reduce hopping of the recording materials P when the rear end of the recording materials passes through the nip of the transfer roller 3, poor images attributed to this can be cleared.

In addition, in the conveyance path following fixing after the rear end of the recording material passes through the nip of the transfer roller pair 3, the loop condition the recording material can be corrected appropriately, thus clearing poor images in the conveyance path after fixing. In addition, curled condition of the recording material can also be stabilized, and thus jamming or poor loading can be prevented.

Second Embodiment

Here, an image forming apparatus according to a second embodiment of the present invention will be described. The image forming apparatus according to the present embodiment is such a configuration that a loop detecting sensor 12 as the loop detecting means also has the operation sensing function for detecting whether or not the operation of conveying recording materials by the fixing roller pair works normally. The loop detecting sensor 12 is capable of detecting operations if the loop detecting sensor detects that the operation does not work normally, for instance, when printing is carried out in out-of-spec conditions, such as operational error by a user, printing on out-of-spec recording materials, or deterioration of parts due to duration, or the like.

Figure 9:
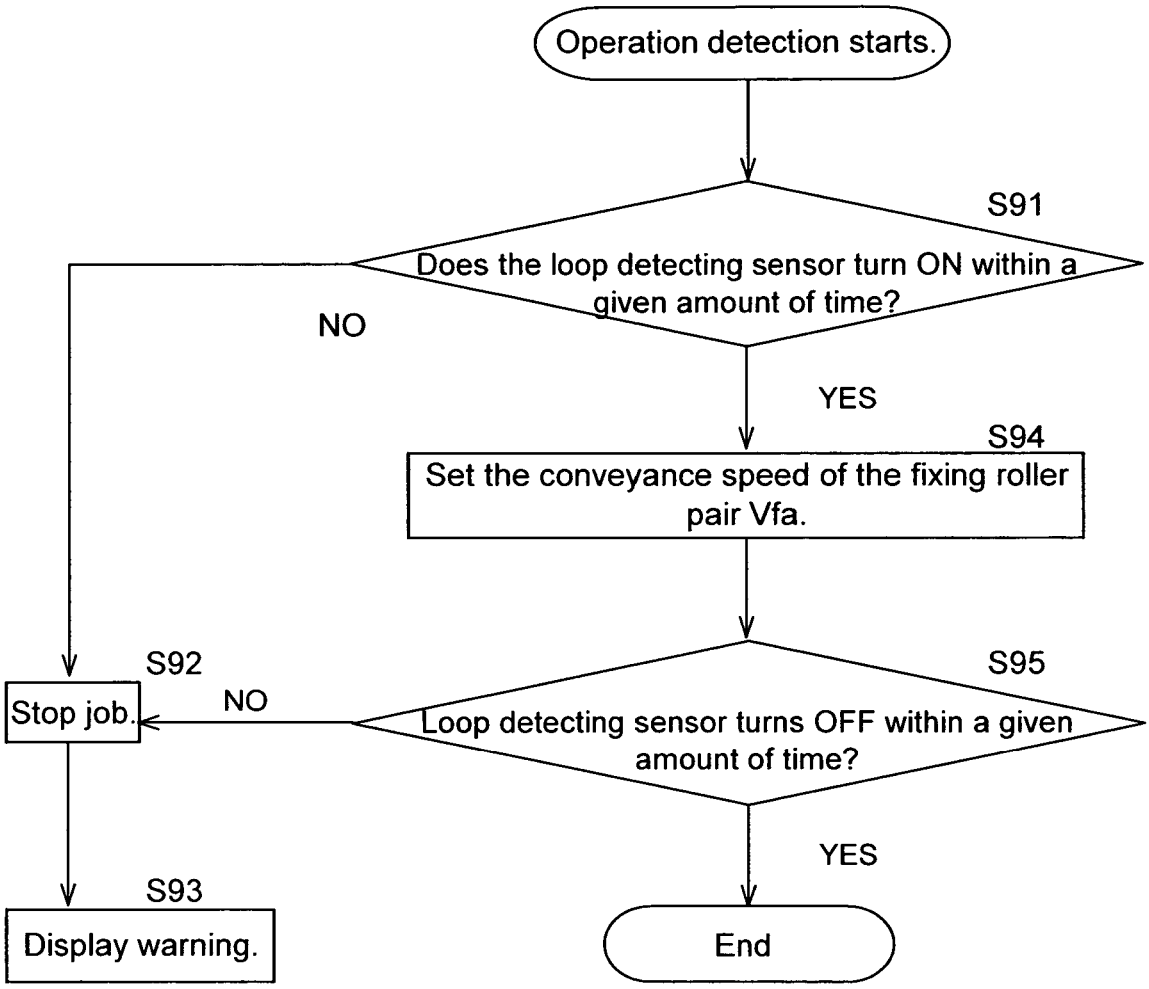
FIG. 9 is a flow chart showing another examples (operation detecting function) of control of the image forming apparatus.
Figure 10:
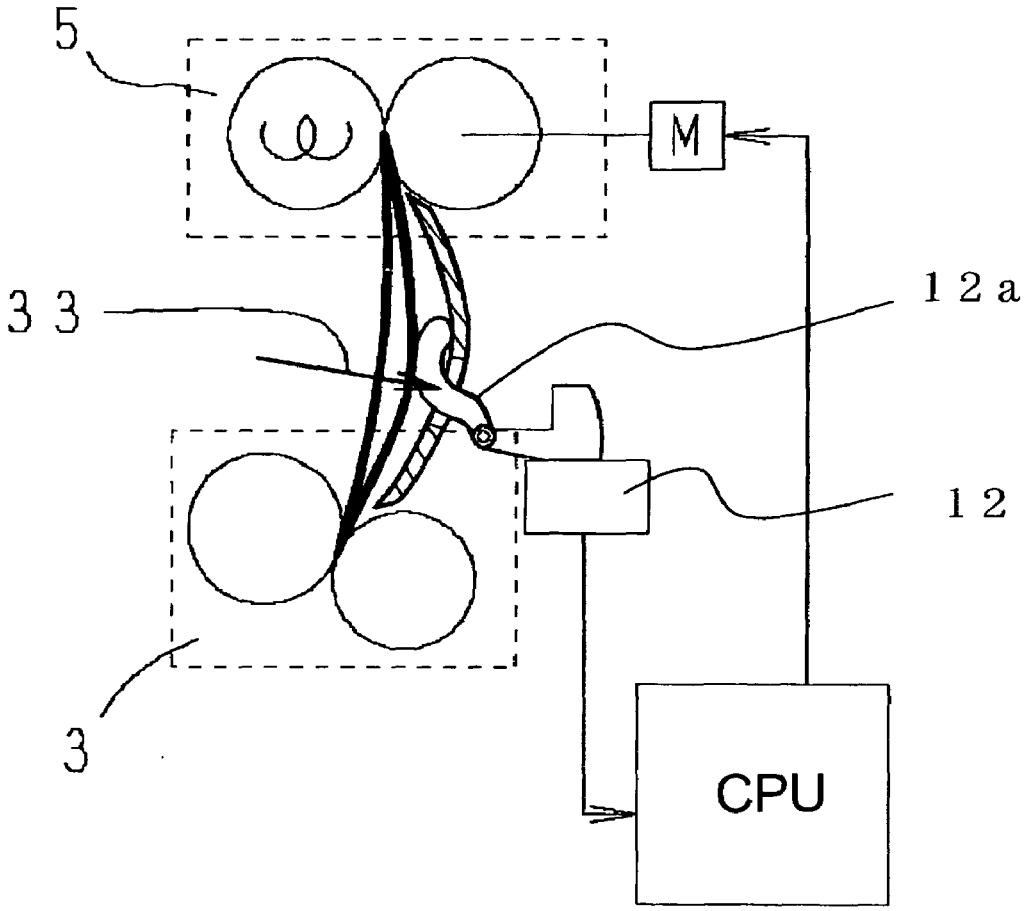
FIG. 10 is a sectional view of a substantial part showing one example of a loop shape between the transfer roller pair and the fixing roller pair.
Figure 11:
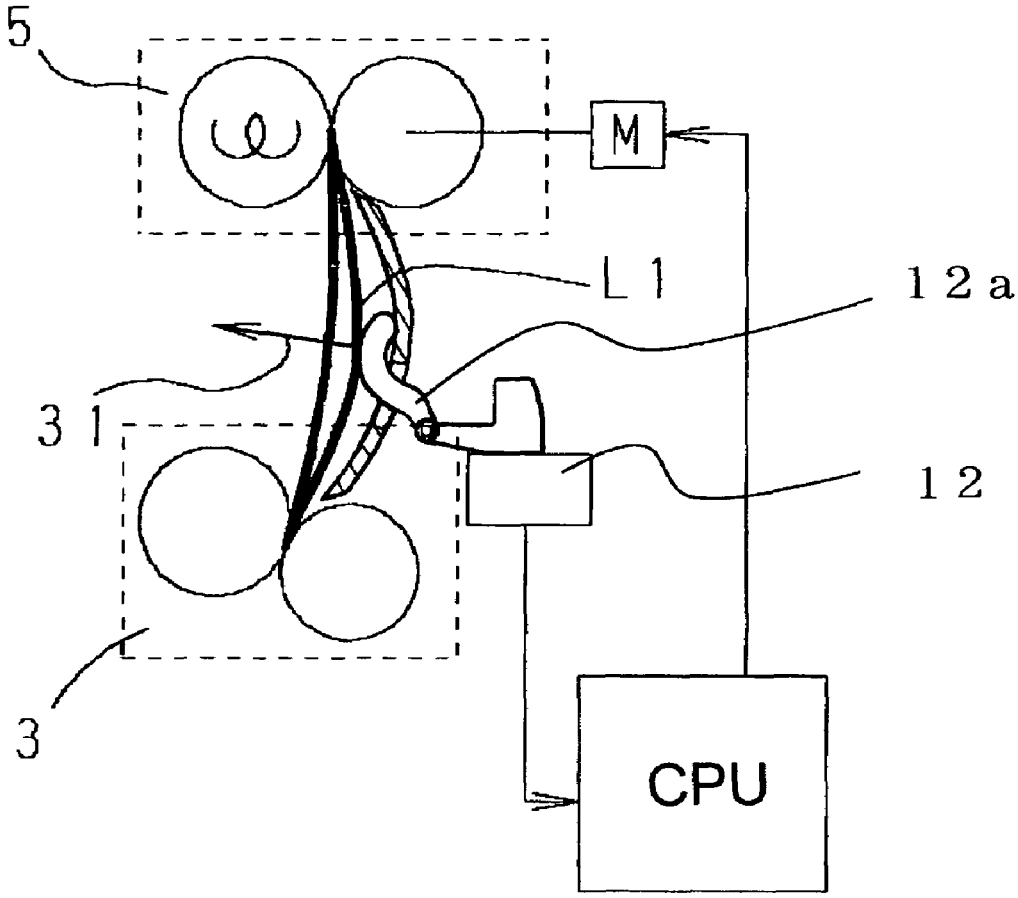
FIG. 11 is a sectional view of a substantial part showing one example of a loop shape between the transfer roller pair and the fixing roller pair.
Figure 12:
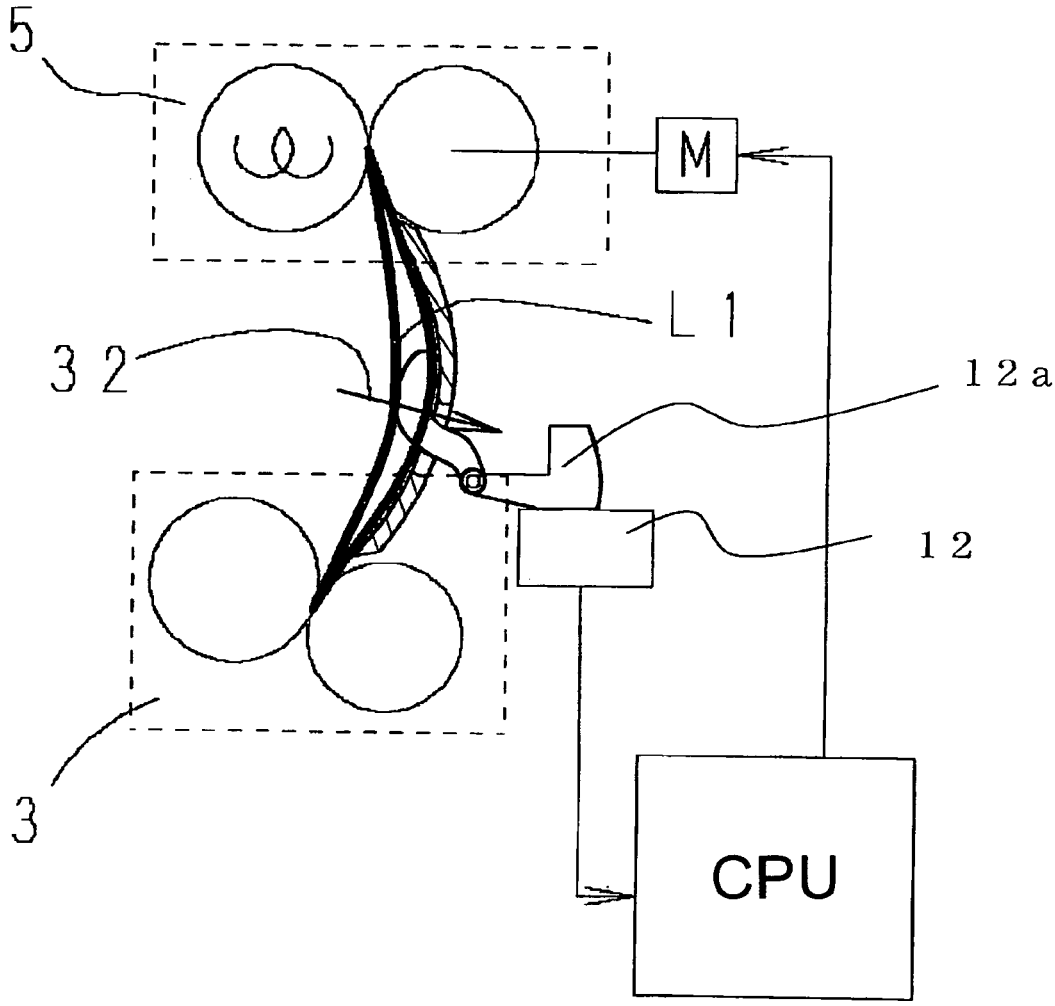
FIG. 12 is a sectional view of a substantial part showing one example of a loop shape between the transfer roller pair and the fixing roller pair.

In the following, the image forming apparatus according to the second embodiment will be described in details, with reference to FIG. 9 to FIG. 12. FIG. 9 is a flow chart showing one example of the operation detecting function. FIG. 10 to FIG. 12 are sectional views showing one example of a loop shape between a transfer roller pair and a fixing roller pair. As schematic configuration of the image forming apparatus is similar to that of the embodiment described above, any components having the same function shall be assigned by the same symbols and the description thereof shall be omitted here.

First, for example, ON timing of the clutch 13 starts the operation detecting function. And, as shown in FIG. 10, after the end of recording material P runs into the nip of the fixing roller pair 5, the loop detecting sensor 12 detects whether or not the recording material P will form a loop within a given amount of time (Step S91). At this time, since the fixing roller pair 5 conveys the recording material P at conveyance speed slower than that of the transfer roller pair 3, if they work normally, a loop will be formed in the arrow direction 33 as shown in FIG. 10, and the loop detecting sensor 12 turns ON within a given amount of time. On the other hand, unless the loop detecting sensor 12 turns ON within a given amount of time from when the clutch 13 of the registration rollers 9 turn ON, the print job is stopped (Step S91), jamming or warning will be displayed to the user (Step S93).

In this case, it is shown that the conveyance speed of recording material by the fixing roller pair 5 is faster than normal condition. Thus, the warning display here shows whether user setting is done as specified, or a message prompting for parts replacement.

If the loop detecting sensor turns ON normally within a given amount of time at the Step S91, as illustrated in the first embodiment, the conveyance speed of the recording material of the fixing roller pair 5 is set to be constant conveyance speed Vfa (Step S94). This allows the recording material P to be conveyed by the fixing roller pair 5 at the constant conveyance speed Vfa, while it is being conveyed by the transfer roller pair 3 at the conveyance speed Vt, Then, the loop detecting sensor 12 detects whether or not the loop of the recording material P is cleared within a given amount of time (Step S95). If the fixing roller pair 5 conveys the recording material P at the constant conveyance speed Vfa, under normal conditions, the loop is cleared in the arrow direction 31 as shown in FIG. 11, and the loop detecting sensor 12 turns OFF within a given amount of time. On the other hand, if the loop detecting sensor 12 does not turn OFF within a given amount of time, the recording material expands the loop toward the arrow direction 32 as shown in FIG. 12. In this case, it is shown that the conveyance speed of the recording material of the fixing roller pair 5 is delayed more than normal conditions. Thus, if the loop detecting sensor 12 does not turn OFF even after a given amount of time has elapsed, the print job is stopped (Step S92), and jamming or warning is displayed to the user (Step S93).

According to the present embodiment, in addition to the effects of the above embodiment, in the case of deterioration due to the elapse of time or out-of-spec setting of the transfer roller pair or the fixing roller pair, the operation can be stopped by detecting loop condition of the recording medium if it does not work normally, and thus can issue a warning to the user.

OTHER EMBODIMENTS

In the above embodiments, as information on recording materials, mode information, information on thickness of recording materials, paper type information and environmental information are used, it is exemplified that the loop control that uses loop length L0, L1, La, Lb of the recording materials based on the various information and length of conveyance direction S of the recording material, however the present invention is not limited to this. As the information on recording materials, information on other recording materials such as mode information such as mode for forming monochrome images, mode for forming color images or the like, may be used. Alternatively, information on these recording materials may be used individually or in combination as appropriate, wherein similar effect to the above embodiments could be expected if loop length L0, L1, La, Lb of recording materials based on the information and length of conveyance direction of the recording material S are stored in the storage means in advance.

In addition, in the present embodiment, a change is made to the speed of the fixing rollers pair 5 after the loop detecting sensor 12 detects the loop, so that the loop length is the lower limit length when the rear end of the sheet is passed through the secondary transfer roller pair 3. However, the change speed may not necessarily be constant. In other words, it may also be acceptable that, by gradually accelerating or decelerating, the loop length will be the lower limit when the rear end of the sheet passes through the secondary transfer roller pair 3.

Although in the above embodiments, it is exemplified that the image forming apparatus that uses the 4 image-forming portions for forming color images, the number of the portions to be used shall not be limited, and may be set appropriately, as necessary.

In addition, in the above embodiments although the printer is exemplified as the image forming apparatus, the present invention shall not be limited to this, and it may be an image forming apparatus that uses other image forming apparatus such as a copying machine or facsimile machine or the like, a complex machine that combines these functions, or an image forming apparatus which uses a recording material bearing member, and sequentially superimposes and transfers toner images of respective colors on recording material born by the recording bearing member, or an image forming apparatus that uses a drum-shaped intermediate transfer member instead of a belt-shaped intermediate transfer member, sequentially superimposes and transfers toner images of respective colors onto the intermediate transfer member, and collectively transfers the toner images born by the intermediate transfer member to the recording material. Application of the present invention to the image forming apparatus can achieve similar effect.

This application claims the benefit of Japanese Application No. 2005-097089 filed on Mar. 30, 2005 hereby incorporated by reference herein in its entirety.

What is claimed is:

1. An image forming apparatus comprising:

transfer means which transfers to recording materials unfixed images borne by an image bearing member;

fixing means which fixes the transferred unfixed image on the recording materials;

loop detecting means which detects a loop of the recording material to be formed between the transfer means and the fixing means;

recording material detection means which determines that the recording materials have reached the fixing means; and control means which controls a conveyance speed of the recording material by the fixing means, wherein based on detected result of the recording material detection means and the loop detecting means, and length of the recording material, the control means sets the conveyance speed of the fixing means so that when the rear end of the recording material passes through the transfer means after the loop detecting means detects a loop of the recording material, a loop length of the recording materials will be set to a lower limit length, and the control means controls the conveyance speed of the fixing means at the set conveyance speed, and wherein when L0 represents loop length of the recording material between the transfer means and the fixing means when the recording material runs into the fixing means, L1 represents loop length of the recording material between the transfer means and the fixing means when a loop is detected, La represents the lower limit loop length of the recording material between the transfer means and the fixing means, Lb represents upper limit loop length of the recording material between the transfer means and the fixing means, relation among the loop length of the recording materials is La<L0<L1<Lb, Vt represents conveyance speed of the recording material of transfer means, Vf represents conveyance speed of the recording material of fixing portion before a loop is detected, S represents length in the conveyance direction of the recording material, and T represents loop formation time after the recording material enters the fixing means till when the loop detecting means detects the loop of the recording material, conveyance speed Vfa of the recording material by the fixing means to be set by the control means is constant conveyance speed that satisfies the following relation:

$$Vt+(L1-Lb)\times Vt/(S-Vt\times T-L0)\leqq Vfa$$

$$Vfa\leqq Vt+(L1-La)\times Vt/(S-Vt\times T-L0).$$

2. The image forming apparatus according to claim 1, further comprises a storage means in which setting information of loop length L0, L1, La, Lb according to types of recording materials has been stored in advance.

3. The image forming apparatus according to claim 1, further comprises a storage means in which setting information of loop length L0, L1, La, Lb according to the environmental conditions has been stored in advance.

4. The image forming apparatus according to claim 1, further comprises a storage means in which setting information of loop length L0, L1, La, Lb according to mode information showing image formation on one side or both sides of the recording materials has been stored in advance.

5. The image forming apparatus according to any of claims 1 to 4, wherein the loop detecting means also has operation detecting function which detects whether or not the operation of conveying the recording material by the fixing means works normally.

* * * * *

UNITED STATES PATENT AND TRADEMARK OFFICE

CERTIFICATE OF CORRECTION

PATENT NO. : 7,398,027 B2
APPLICATION NO. : 11/386805
DATED : July 8, 2008
INVENTOR(S) : Koshida et al.

It is certified that error appears in the above-identified patent and that said Letters Patent is hereby corrected as shown below:

COLUMN 2:
Line 1, “faster” should read --faster than--.

COLUMN 3:
Line 1, “another examples” should read --another example--.
Line 21, “details. Pro-” should read --detail; pro- --.
Line 64, “the like.” should read --the like--.

COLUMN 4:
Line 57, “conveyed” should read --is conveyed--.
Line 58, “being” should read --are being--.
Line 62, “discharge try” should read --discharge tray--.

COLUMN 6:
Line 66, “that detects” should read --detects--.

COLUMN 7:
Line 63, “materials” should read --materials P--.

COLUMN 9:
Line 15, “material.” should read --materials P.--.

COLUMN 10:
Line 12, “condition” should read --condition of--.
Line 34, “in details,” should read --in detail,--.

COLUMN 11:
Line 37, “material,” should read --material;--.
Line 60, “that uses” should read --uses--.

UNITED STATES PATENT AND TRADEMARK OFFICE

CERTIFICATE OF CORRECTION

PATENT NO. : 7,398,027 B2
APPLICATION NO. : 11/386805
DATED : July 8, 2008
INVENTOR(S) : Koshida et al.

It is certified that error appears in the above-identified patent and that said Letters Patent is hereby corrected as shown below:

COLUMN 12:
Line 5, “born” should read --borne--.
Line 11, “born” should read --borne--.

Signed and Sealed this

Third Day of February, 2009

JOHN DOLL
*Acting Director of the United States Patent and Trademark Office*